US008403633B2

(12) United States Patent
Hwang et al.

(10) Patent No.: US 8,403,633 B2
(45) Date of Patent: Mar. 26, 2013

(54) COOLING FAN

(75) Inventors: Ching-Bai Hwang, Taipei Hsien (TW); Po-Hsuan Kuo, Taipei Hsien (TW)

(73) Assignee: Foxconn Technology Co., Ltd., New Taipei (TW)

( * ) Notice: Subject to any disclaimer, the term of this patent is extended or adjusted under 35 U.S.C. 154(b) by 838 days.

(21) Appl. No.: 12/489,417

(22) Filed: Jun. 22, 2009

(65) Prior Publication Data

US 2010/0104421 A1 Apr. 29, 2010

(30) Foreign Application Priority Data

Oct. 23, 2008 (CN) ..... 2008 1 0305097

(51) Int. Cl.
*F04D 29/66* (2006.01)

(52) U.S. Cl. ..... 415/119; 415/197; 415/206

(58) Field of Classification Search ..... 415/119, 415/196, 197, 206
See application file for complete search history.

(56) References Cited

U.S. PATENT DOCUMENTS

| | | | | |
|---|---|---|---|---|
| 5,108,833 | A * | 4/1992 | Noguchi et al. | 428/310.5 |
| 6,463,230 | B1 * | 10/2002 | Wargo | 399/92 |
| 8,083,477 | B2 * | 12/2011 | Hwang et al. | 415/206 |
| 2002/0146318 | A1 * | 10/2002 | Horng | 415/204 |
| 2009/0053053 | A1 * | 2/2009 | Lin | 415/206 |

FOREIGN PATENT DOCUMENTS

| | | | |
|---|---|---|---|
| CN | 1798928 | A | 7/2006 |
| CN | 200810303725 | * | 8/2008 |
| JP | 61-192899 | A | 8/1986 |
| JP | 05240193 | A * | 9/1993 |
| WO | 2004090337 | A1 | 10/2004 |

* cited by examiner

*Primary Examiner* — Edward Look
*Assistant Examiner* — Jason Davis
(74) *Attorney, Agent, or Firm* — Altis Law Group, Inc.

(57) ABSTRACT

A cooling fan includes a housing, a cover on the housing and an impeller received in a space between the housing and the cover. The housing includes a bottom wall and a sidewall projecting upwardly from an outer periphery of the bottom wall. The sidewall defines an air outlet therein. The impeller includes a hub and a plurality of blades extending radially out from the hub. A porous layer extends into the space between the housing and the cover from the sidewall at a location adjacent to the air outlet.

13 Claims, 3 Drawing Sheets

COOLING FAN

BACKGROUND

1. Technical Field

The present disclosure relates to cooling fans, and particularly to a cooling fan which has a reduced noise when an impeller thereof rotates.

2. Description of Related Art

It is well known that if heat generated by electronic components, such as integrated circuit chips, is not efficiently dissipated during operation, these electronic components may suffer damage. Thus, cooling fans are often used to cool the electronic components.

A typical cooling fan includes a housing, a cover on the housing, and a stator and an impeller received in a space defined between the housing and the cover. The housing includes a bottom wall and a sidewall extending upwardly from the bottom wall. The sidewall defines an air outlet therein. The air outlet includes a near side and a rear side at two opposite sides. A tongue is formed adjacent to the rear side of the air outlet. The tongue extends from the sidewall into the space between the housing and the cover, and protrudes toward the impeller. The impeller includes a hub and a plurality of blades extending radially and outwardly from the hub. An air channel is defined between free ends of the blades and the sidewall of the housing with a width increasing from the rear side toward the near side of the air outlet, so as to increase a pressure of an airflow generated by the impeller.

When the cooling fan operates, the blades of the impeller drive air therebetween to rotate to generate forced airflow, and then the airflow flows along the air channel to the air outlet. However, when the airflow flows through the tongue, the airflow separates from the tongue and generates a vortex thereat. The vortex strikes the tongue and thus generates noise which makes a user near the cooling fan feel uncomfortable.

What is needed, therefore, is a cooling fan which overcomes the above-described limitations.

BRIEF DESCRIPTION OF THE DRAWINGS

Many aspects of the present cooling fan can be better understood with reference to the following drawings. The components in the drawings are not necessarily drawn to scale, the emphasis instead being placed upon clearly illustrating the principles of the disclosed cooling fan. Moreover, in the drawings, like reference numerals designate corresponding parts throughout the several views.

DETAILED DESCRIPTION

Figure 1:
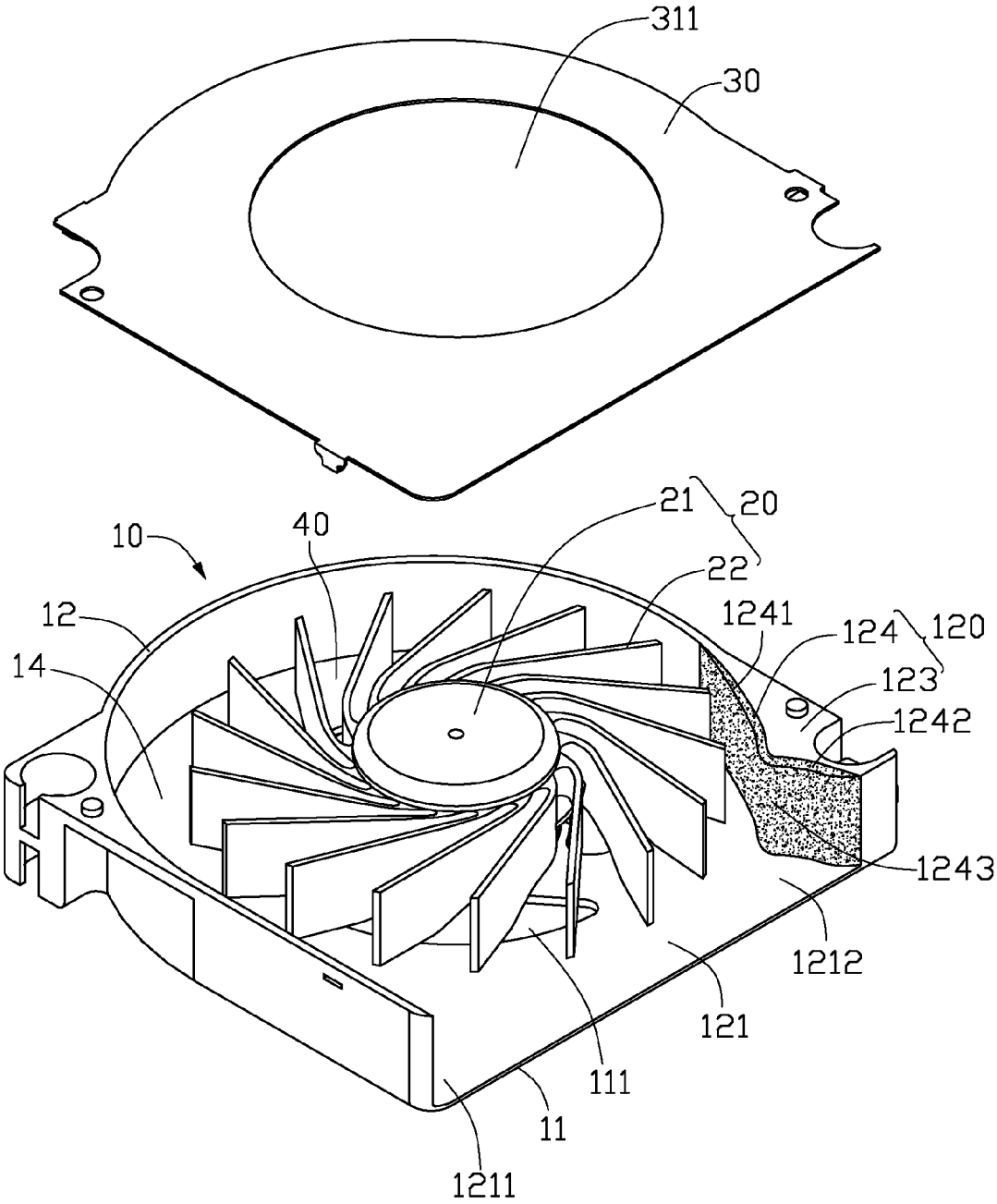
FIG. 1 is an exploded, isometric view of a cooling fan in accordance with a first embodiment of the disclosure.
Figure 2:
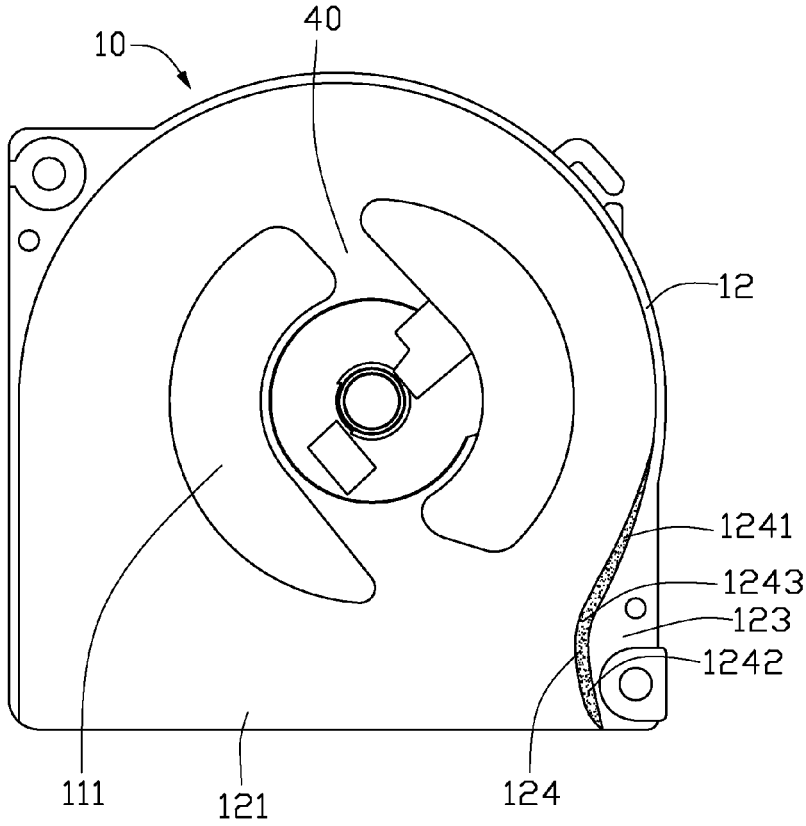
FIG. 2 is a top plan view of a housing of the cooling fan of FIG. 1.

Referring to FIGS. 1 and 2, a cooling fan in accordance with a first embodiment of the disclosure is shown. The cooling fan includes a housing 10, a cover 30 on the housing 10, and a stator (not shown) and an impeller 20 received in a space 40 between the housing 10 and the cover 30.

The impeller 20 includes a hub 21 and a plurality of blades 22 extending radially out from an outer periphery of the hub 21. The cover 30 defines an air inlet 311 therein over the impeller 20.

The housing 10 includes a bottom wall 11 and a sidewall 12 extending upwardly from an outer periphery of the bottom wall 11 and surrounding the space 40. The bottom wall 11 defines an air inlet 111 therein aligning with the air inlet 311 of the cover 30. The sidewall 12 defines an air outlet 121 which is perpendicular to the air inlets 111, 311. The air outlet 121 includes a near side 1211 and a rear side 1212 at opposite sides thereof. An air channel 14 is defined between free ends of the blades 22 of the impeller 20 and an inner surface of the sidewall 12 of the housing 10. During operation of the cooling fan, the impeller 20 rotates in a counterclockwise direction as viewed from FIG. 1, and drives airflow into the space 40 via the air inlets 111, 311. The airflow then flows through the channel 14 from the rear side 1212 to the near side 1211 along the inner surface of the side wall 12, and finally flows out from the cooling fan through the air outlet 121. The sidewall 12 has a triangular protrusion 123 extending into the space 40 adjacent to the rear side 1212 of the air outlet 121.

A porous layer 124 is intimately adhered to an inner surface of the protrusion 123 which faces the blades 22 of the impeller 20. The porous layer 124 is of porous, acoustic absorbing material, such as sponge, foamed plastic, glass wool or fibers. The porous layer 124 has a height equal to that of the protrusion 123 along an axial direction of the hub 21. In other words, the porous layer 124 does not extend upwardly beyond the protrusion 123 along the axial direction of the hub 21. The porous layer 124 is laminar, and includes an inner flake 1241 away from the rear side 1212 of the air outlet 121, an outer flake 1242 adjacent to the rear side 1212 of the air outlet 121, and a middle flake 1243 smoothly and integrally interconnecting the inner and outer flakes 1241, 1242. The inner flake 1241, the outer flake 1242 and the middle flake 1243 cooperatively form a V-shaped structure of the porous layer 124, as viewed from a top of the housing 10. The middle flake 1243 has a substantially uniform thickness. The inner flake 1241 has a thickness gradually decreasing along a direction away from the middle flake 1243 toward the inner flake 1241 to thereby have a smooth connection with the sidewall 12 at a free end of the inner flake 1241. The outer flake 1242 also has a thickness gradually decreasing along a direction away from the middle flake 1243 toward the outer flake 1242 to thereby have a smooth connection with the sidewall 12 at a free end of the outer flake 1242. The porous layer 124 and the protrusion 123 cooperatively form a tongue 120 with a V-shaped inner surface. The tongue 120 extends into the space 40 and protrudes toward the free ends of the blades 22, whereby the air channel 14 forms a volute structure. Specifically, a width of the air channel 14 in a radial direction of the impeller 20 increases along a counterclockwise direction from the rear side 1212 toward the near side 1211 of the air outlet 121, so as to increase a pressure of an airflow generated by the impeller 20.

In the cooling fan, the porous layer 124 of the tongue 120 with pores forms a rough inner surface facing the blades 22. The rough inner surface of the tongue 120 prolongs the period of time of the airflow contacting with the tongue 120 after the airflow has impacted on the tongue 120. In other words, in accordance with the present disclosure, the period of time from the impact of the airflow on the tongue 120 to the separation of the airflow from the tongue 120 is longer than the prior art whose inner surface of the tongue is smooth. Thus, the possibility of formation of vortex by the airflow adjacent to the tongue 120 is reduced, and thus a noise generated by the cooling fan during operation thereof can be reduced. In addition, the porous layer 124 of the tongue 120 can absorb and cushion the impact force of the airflow generated by the blades 22 on the tongue 120, which further reduces the noise generated by the operation of the cooling fan.

Figure 3:
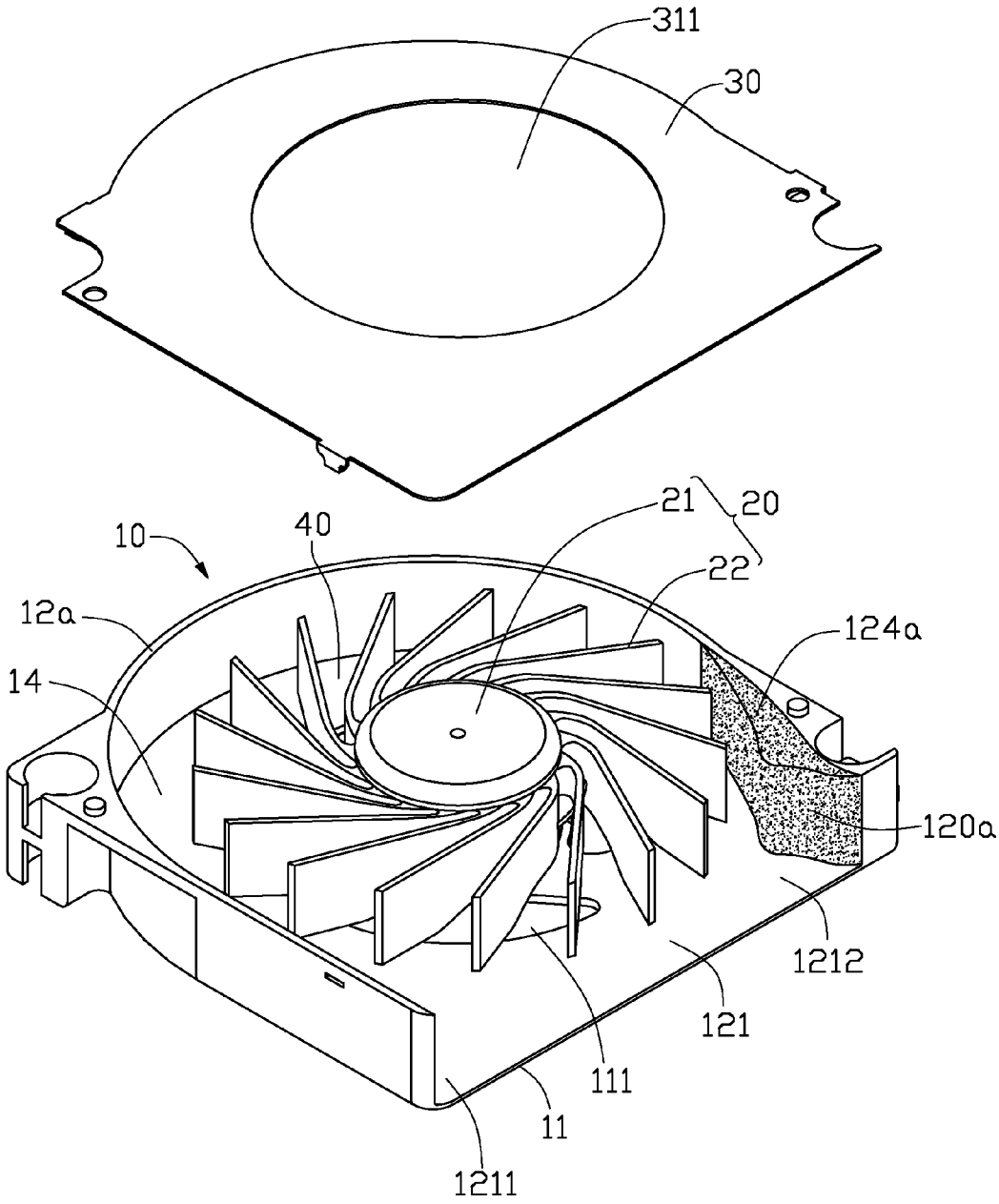
FIG. 3 is an exploded, isometric view of a cooling fan in accordance with a second embodiment of the disclosure.

Referring to FIG. 3, a cooling fan in accordance with a second embodiment of the disclosure is shown. The difference between the cooling fan in this embodiment and the cooling fan in the first embodiment is that the porous layer 124*a* has a triangle-shaped structure, as viewed from the top of the hosing 10. The porous layer 124*a* constructs the tongue 120*a* with a V-shaped inner surface, and has a substantially linear outer side directly attached to an inner surface of the sidewall 12*a*. The porous layer 124*a* extends into the space 40 and protrudes toward the free ends of the blades 22.

It is believed that the disclosure and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A cooling fan, comprising:

a housing comprising a bottom wall and a sidewall extending upwardly from an outer periphery of the bottom wall, the sidewall defining an air outlet therein;

a cover on the sidewall of the housing;

an impeller received in a space between the housing and the cover, comprising a hub and a plurality of blades extending radially out from the hub; and a porous layer attached to an inner surface of the sidewall and extending into the space between the housing and the cover from the sidewall at a position adjacent to the air outlet, the blades rotating in a counterclockwise direction from the porous layer along the inner surface of the sidewall.

2. The cooling fan of claim 1, wherein the porous layer is of porous, acoustic absorbing material.

3. The cooling fan of claim 2, wherein the porous layer is made of one of sponge, foamed plastic, glass wool and fibers.

4. The cooling fan of claim 1, wherein the sidewall has a triangular protrusion extending into the space adjacent to the air outlet, the porous layer being laminar and intimately adhered to a surface of the protrusion facing the blades, the porous layer comprising an inner flake away from the air outlet, an outer flake adjacent to the air outlet, and a middle flake smoothly and integrally interconnecting the inner and outer flakes, the inner flake, the outer flake and the middle flake cooperatively forming a V-shaped structure of the porous layer.

5. The cooling fan of claim 4, wherein the inner flake has a thickness gradually decreasing along a direction away from the middle flake toward the inner flake to thereby have a smooth connection with the sidewall at a free end of the inner flake, and the outer flake also has a thickness gradually decreasing along a direction away from the middle flake toward the outer flake to thereby have a smooth connection with the sidewall at a free end of the outer flake.

6. The cooling fan of claim 4, wherein the porous layer has a height equal to that of the protrusion along an axial direction of the hub.

7. The cooling fan of claim 1, wherein the porous layer has a triangular structure, which has a substantially linear side directly attached to the inner surface of the sidewall.

8. The cooling fan of claim 1, wherein the air outlet comprises a near side and a rear side at opposite sides thereof, the impeller and the sidewall cooperatively defining an air channel therebetween, the airflow being driven to flow from the rear side to the near side through the air channel along the inner surface of the sidewall during operation of the impeller, the porous layer being located adjacent to the rear side of the air outlet and protruding toward free ends of the blades.

9. A cooling fan, comprising:

a bottom wall;

a cover;

a sidewall connecting the bottom wall with the cover, the sidewall defining an air outlet therein;

an impeller received in a space among the bottom wall, the sidewall and the cover, comprising a hub and a plurality of blades extending radially out from the hub; and a tongue with a V-shaped inner surface extending from the sidewall adjacent to the air outlet into the space among the bottom wall, the sidewall and the cover, the tongue comprising a protrusion and a porous layer, the porous layer facing toward free ends of the blades, the blades rotating in a counterclockwise direction from the porous layer along an inner surface of the sidewall.

10. The cooling fan of claim 9, wherein the porous layer is made of one of sponge, foamed plastic, glass wool and fibers.

11. The cooling fan of claim 9, wherein the protrusion is a triangular protrusion extending into the space adjacent to the air outlet, and the porous layer is laminar and adhered to an inner surface of the protrusion.

12. The cooling fan of claim 11, wherein the porous layer comprises an inner flake away from the air outlet, an outer flake adjacent to the air outlet, and a middle flake smoothly and integrally interconnecting the inner and outer flakes, the inner flake, the outer flake and the middle flake cooperatively forming a V-shaped structure of the porous layer.

13. The cooling fan of claim 9, wherein the air outlet comprises a near side and a rear side at opposite sides thereof, the impeller and the sidewall cooperatively defining an air channel therebetween, the airflow being driven to flow from the rear side to the near side through the air channel along the inner surface of the sidewall during operation of the impeller, the porous layer being located adjacent to the rear side of the air outlet.

* * * * *